United States Patent [19]

Tabor et al.

[11] 4,062,429

[45] Dec. 13, 1977

[54] COMBINED GARMENT BAG AND CARRIER

[76] Inventors: Martin A. Tabor; Abby F. Tabor, both of 7322 SW. 146th Terrace; Clyde A. Laing, 401-5255 NW. 87th Ave., all of Miami, Fla. 33158

[21] Appl. No.: 641,277

[22] Filed: Dec. 16, 1975

[51] Int. Cl.[2] ..... A45C 5/14

[52] U.S. Cl. ..... 190/18 A; 190/41 B; 190/43

[58] Field of Search ..... 190/18 A, 41 B, 41 Z, 190/43; 280/37, 47.26, 47.17

[56] References Cited

U.S. PATENT DOCUMENTS

| | | | |
|---|---|---|---|
| 1,757,490 | 5/1930 | Tibbetts | 190/18 A UX |
| 2,754,945 | 7/1956 | Kish | 190/43 |
| 3,141,535 | 7/1964 | Hamilton | 190/41 B |
| 3,917,038 | 11/1975 | Foge | 190/18 A |

*Primary Examiner*—Donald F. Norton
*Attorney, Agent, or Firm*—Duckworth, Hobby & Allen

[57] ABSTRACT

A combined garment bag and carrier constructed as a unit consisting of a garment bag, a pair of ground engaging wheels secured to the bottom portion thereof, tubular members extending within and along the full length of the garment bag to maintain the garment bag in an extended position, means mounted at the midportion of the tubular members permitting the folding of the garment bag, a sleeve slidably mounted on the tubular members preventing the folding of the garment bag, a handle secured to the tubular means at the top portion of the garment bag for actuating the sleeve to its folding and non-folding positions, and a foldable bracket mounted adjacent to the wheels for carrying luggage thereon.

17 Claims, 9 Drawing Figures

COMBINED GARMENT BAG AND CARRIER

BACKGROUND OF THE INVENTION

1. Field of the Invention

This invention relates to garment bags and is more particularly directed to a combined garment bag and carrier therefor.

2. Description of the Prior Art

At the present time there are many conventional combined baggage and carriers, but there are no foldable garment bags having wheels attached thereto as a unit. There are hand pulled carts which are constructed to receive and to carry a garment bag for hauling the garment bag, but the latter must be removed from the carrier in order to unfold the bag and hang it on a hook in order to have access to the clothing. The main objection to a separate carrier for a garment bag is that during the shipping of the separate carrier and garment bag the latter has to be packed in order to avoid being broken or lost. Also, when not in use the carrier and the garment bag are not usually stored together, the one in a storage area while the other is stored in a closet, thereby again incurring the possibility of misplacement or loss of the carrier.

The present invention contemplates avoiding the above indicated objections to and inconveniences of separate garment bags and carriers by providing a combined garment bag and carrier therefor.

BRIEF SUMMARY OF THE INVENTION

Therefore a principal object of the present invention is to provide a combined garment bag and carrier constructed as a unit that permits a garment bag to contain clothing therein, that folds readily for shipping purposes and which is readily unfolded to its extended position for drawing along the ground on its wheels.

Another object of the present invention is to provide a combined foldable garment bag and carrier that is capable of standing in an extended position with a handle at its upper portion, a pair of ground engaging wheels at its lower end and a pivoted bracket for receiving baggage mounted in proximity of the wheels.

A further object of the present invention is to provide a combined garment bag and carrier with a slidable handle that is normally used for drawing the garment bag in its extended position on its wheels and actuated to permit the folding of the garment bag when stored on a plane, train, etc.

A still further object of the present invention is to provide a combined garment and carrier that can be hung in a closet with the clothes contained therein and available to the user without the necessity of having to separate the garment bag from the carrier and store the carrier separately of the garment bag.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

DETAILED DESCRIPTION OF THE PREFERRED EMBODIMENT

Figure 1:
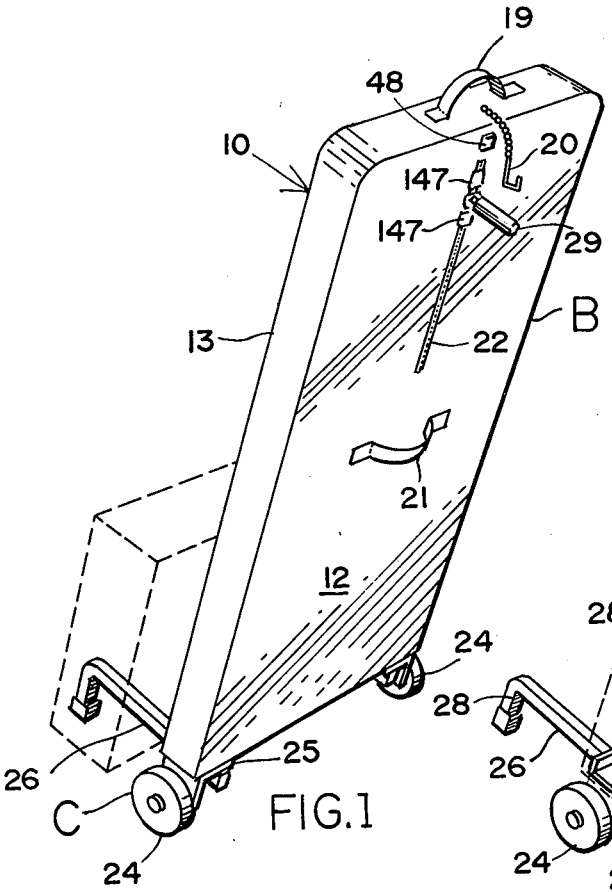
FIG. 1 is a perspective view of a combined garment bag and carrier constructed in accordance with my invention with baggage shown by dotted lines being carried thereon.
Figure 2:
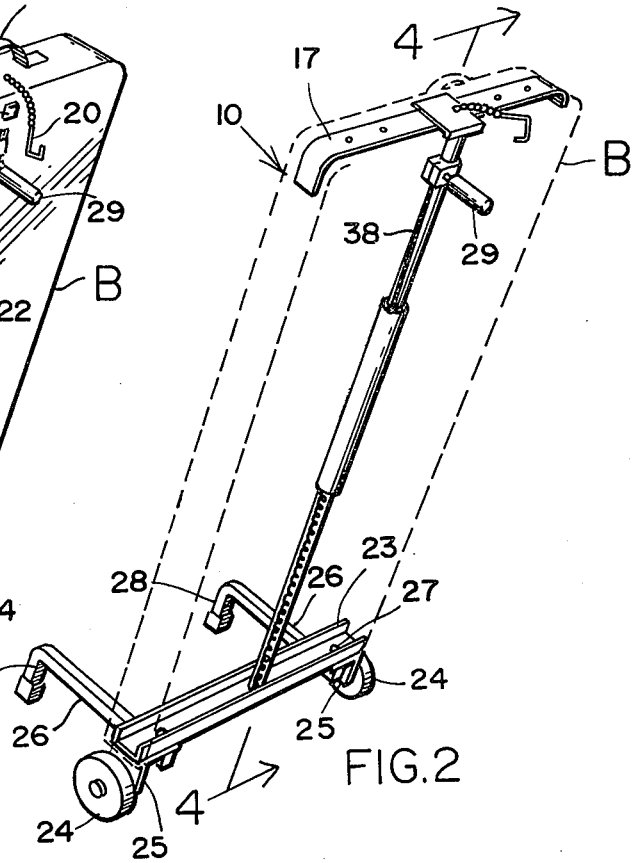
FIG. 2 is a similar view showing the garment bag by dotted lines for revealing the inner structure thereof.

Referring to the drawings wherein like numerals are used to designate similar parts throughout the several views, the numeral 10 refers to my combined garment bag and carrier consisting generally of a conventional garment bag -B- slightly modified as explained in detail hereinafter and a carrier assembly -C-.

As stated, the garment bag -B- is to all extent and purposes conventional except for the minor changes made thereon as indicated hereinafter to accommodate the garment bag -B- to the carrier -C- in order to produce my combined garment bag and carrier 10. The garment bag -B- consists of front and rear walls 11 and 12 of pliable material or cloth spaced apart by an end wall 13 which is fastened as by sewing about the entire periphery of the front and rear walls 11 and 12 to form a compartment or chamber 14 for containing clothes hung therein. Extending along the full length of the front wall 11 of the garment bag -B- is a vertically disposed slit or opening 15 for gaining access to the compartment 14. At the opening 15 is a zipper formed by interlocking members 16 sewn along each edge of the pliable material 15 with a zipper head 116 mounted therealong for opening and closing the opening 15. At the top portion of the compartment 14, a reinforcement plate 17 is fastened to the top portion of the end wall 13 for supporting a bracket 18 mounted thereon. The bracket 18 receives coat hangers on which suits, dresses and the like are hung. On the outside of the garment bag 10, a strap handle 19 and a hook 20 are found secured to the top end wall 13 for carrying by hand and hanging the garment bag respectively. In a conventional garment bag, the rear wall 12 has no openings but is provided with pockets (not shown) for containing articles of clothing not capable of being hung on the inside of the bag 10 with a strap handle 21 at the mid-portion for carrying the bag 10 when in a folded position. The present rear wall 12 differs from that of the conventional garment bag by having a vertical opening or slit 22 at the top half thereof for permitting a handle 29 whose function is explained hereinafter, to extend therethrough.

Mounted across and in the bottom of the compartment 14 along the bottom end wall 13 is a U-shaped channel member 23 to provide a support for L-shaped brackets 25 on which wheels 24 are rotatably mounted. A pair of leg portions 26 are also mounted on the channel member 23 by a pivot pin 27 to permit the swinging of the leg portions 26 beneath and in coplanar relation with the bag 10 when not in use and outwardly to form a shelf for baggage when in use. Foot portions 28 extend downwardly and engage the floor for supporting the bag 10 in an upright position.

Figure 7:
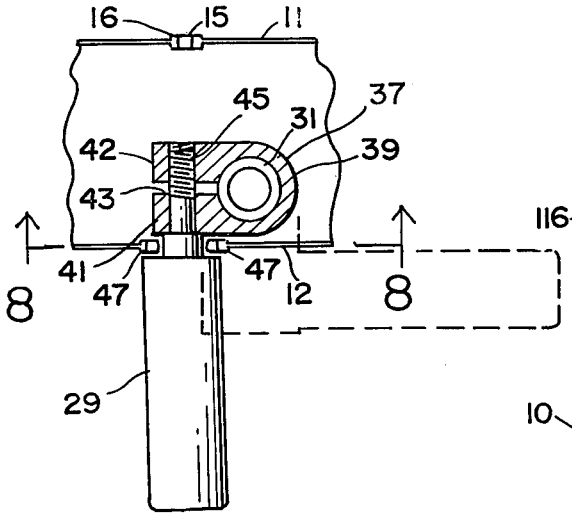
FIG. 7 is a fragmentary cross sectional view taken along the line 7—7 of FIG. 4.
Figure 5:
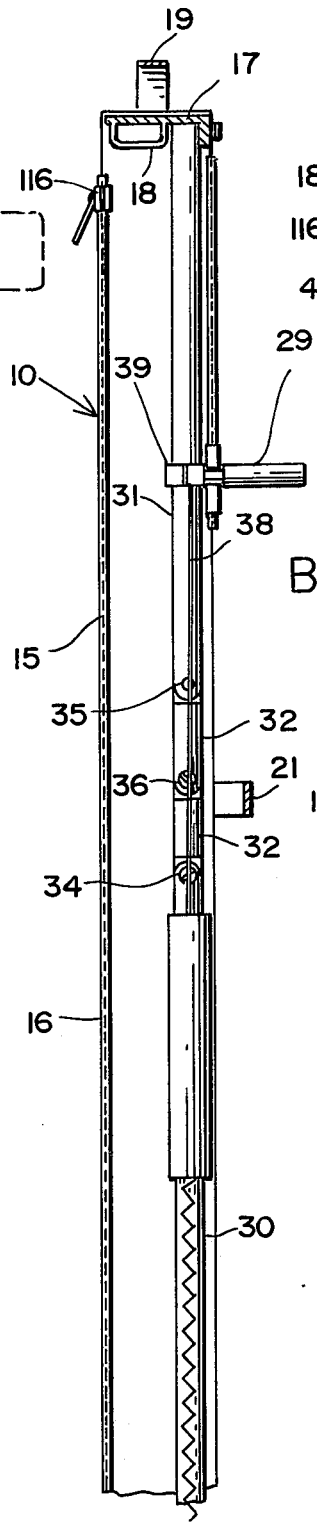
FIG. 5 is a similar view showing the handle actuated to permit the folding of the garment bag.
Figure 4:
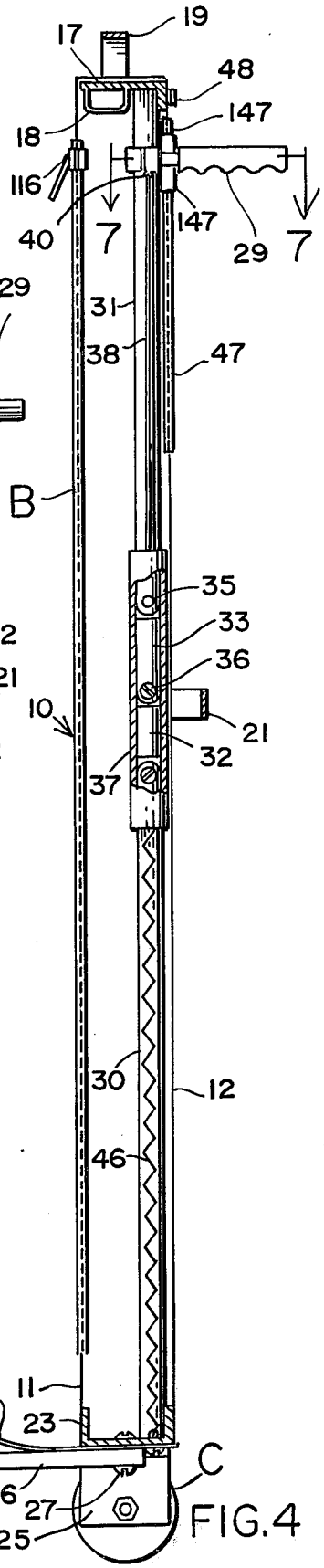
FIG. 4 is a cross sectional view taken along the line 4—4 of FIG. 2.

Extending upwardly of the channel member 23 and extending downwardly of the reinforcing plate member 17 are identical tubular members 30 and 31 of equal length and positioned in alignment with the opening 22 which is at the center of the bag 10. There are two links 32 and 33 pivotally secured as at 34 and 35 to the free ends of the members 30 and 31 respectively and the links 32 and 33 are provided together by a pivot pin 36. Slidably mounted on the tubular members 30, 31, and the links 32, 33 is a sleeve 37 that is suspended in proximity of the links 32, 33 by means of a wire 38 fastened at one end to the top portion of the sleeve 37 and extends upwardly along the member 38 to a handle support 39 as at 40 secured to the handle 29. The handle support 39 extends about the pipe 31 forming leg portions 41 and 42 that are in spaced relation to each other. The leg portion 41 is provided with a bore 43 while the leg portion 42 is provided with a threaded bore for receiving a threaded stem 45 extending from the handle 29. By rotating the handle 29 in one direction, the handle 29 bearing against the leg portion 41 will draw the two leg portions 41 and 42 together to secure the handle support 39 against movement on the pipe 31. Upon rotating the handle 29 in the opposite direction the stem 45 will thread outwardly of the bore 44 and permit the support 39 to be loosened of the pipe 31 so that the handle 29 can be slid laterally of the pipe 31 or be rotated against the bag 10 to the dotted line position as shown by FIG. 7. The sleeve 37 is connected by a coil spring 46 that extends from the bottom portion of the sleeve 37 to the channel member 23 to yieldingly urge the sleeve 37 in a downward direction along the pipe 30.

Figure 6:
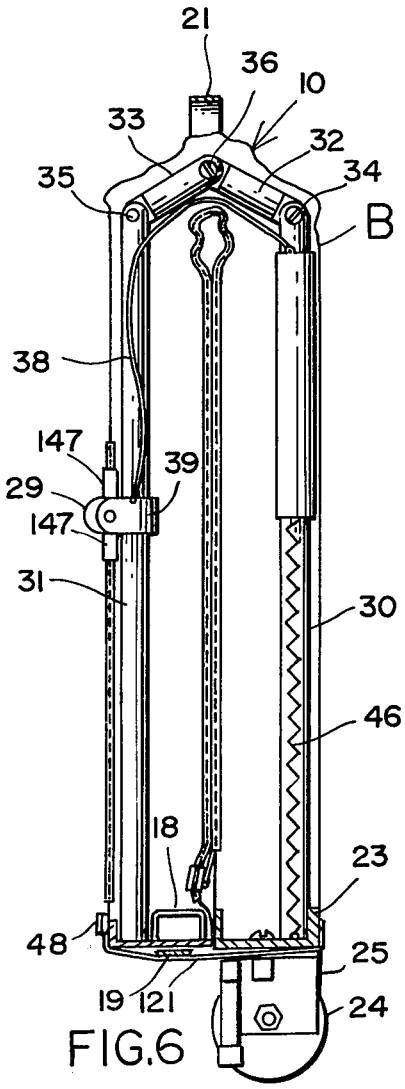
FIG. 6 is a similar view showing the garment bag in a folded position.

The handle 29 extends through the opening 22 which similar to the opening 15 is provided with opposing and interlocking zipper members 47. Engaging the interlocking members 47 is a pair of zipper heads 147 secured to either side of the handle 29. The zipper heads 147 are oppositely positioned on the interlocking members 47 so that as the handle 29 is slid along the opening 22, one zipper head 147 causes the interlocking members 47 to become disengaged and allow the handle 29 to move therealong as the other zipper head 147 causes the interlocking members 47 on each side of the opening 22 to become interengaged. Consequently, the opening 22 is always in a closed position except for the portion through which the handle 29 extends, notwithstanding the movement and position of the handle 29 in the opening 22. Above the handle 29 at the top portion of the wall 12 is a fastener 48 for engaging a strap 121 when the bag 10 is in its folded position as shown by FIG. 6.

Figure 3:
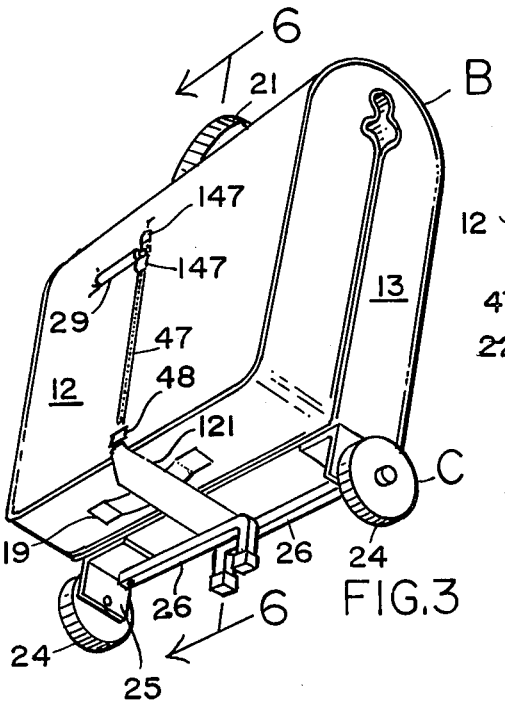
FIG. 3 is a similiar view showing the bag in a folded position.
Figure 8:
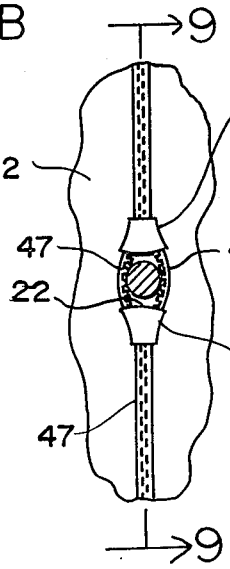
FIG. 8 is a cross sectional view taken along the line 8—8 of FIG. 7.
Figure 9:
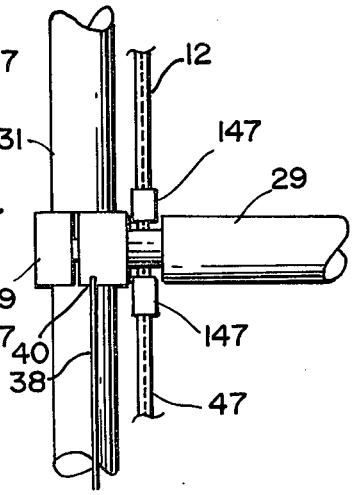
FIG. 9 is a cross sectional view taken along the line 9—9 of FIG. 8.

As is readily noted by the above description taken in connection with the drawings, the otherwise conventional garment bag -B- combined with the carrier -C- provides a garment bag 10 that is capable of being folded with clothing contained therein as shown by FIG. 3 or being drawn along the ground in an extended position with additional baggage positioned on its baggage rack as shown by FIG. 1. With the device 10 in its extended position, the handle 29 has been rotated to its extended position to permit a person to grasp it and draw the combined garment bag and carrier 10 along the ground. When it is necessary to fold the combined garment bag and carrier 10 as shown by FIG. 3, the handle 29 is unthreaded to loosen the support 39 on the tubing 31 to cause the coil spring 46 to compel the sleeve 37 and handle 29 to slide downwardly. The pivot links 32 and 33 become released and thereby permit the bag -B- to fold in half. The baggage carrying brackets 26 are pivoted to their position beneath the channel member 23 and the strap 21 is fastened to its locking member 48. Now the folded device 10 can be lifted by the strap handle 21 and deposited in the trunk of an automobile or other place to be stored or shipped.

Summarizing the functions of the various structural features described above and shown in the drawing, it will be noted that the braces 17 and 23, the rods 30 and 31, the sleeve 37, and the hinges 32 and 33 function together as means for holding the garment bag -B- in an inflexible and unfolded position. This holding means further includes a first means within the compartment 14 allowing bending of the holding means; this first means includes the hinges 32 and 33, and the spring 46.

Additionally, the holding means includes a second means coupled to the first means and extending through the wall 12 for permitting operation of the first means from outside the container. The second means includes the wire 38, the opening 22, the handle 29 (and associated structural elements including the legs 41 and 42, the bores 43 and 44, and the threaded stem 45).

What I claim as new and desired to secure by Letters Patent is:

1. A combined garment bag and carrier comprising a substantially rectangular and pliable front and rear wall, top, side and bottom end wall means joining said front and rear walls forming an enclosed rectangular compartment for clothing, an opening along said front wall, zipper means enclosing said opening, a pair of ground engaging wheels mounted on said bottom end wall means, elongated means extending from said bottom end wall to said top end wall means, link means mounted at substantially the mid-portion of said elongated means for permitting folding of said garment bag, restraining means releasably mounted on said link means and a handle secured to the top portion of said elongated means for rolling said garment bag along the ground.

2. The structure as recited by claim 1 taken in combination with means cooperatively engaging said handle and said restraining means.

3. The structure as recited by claim 2 wherein said restraining means comprises a slidably mounted sleeve, and a coil spring connecting the lower end portion of said sleeve and said bottom end wall means and yieldingly urging said sleeve in a downward direction, a member joining said handle and the upper end portion of said sleeve and means releasably securing said handle to said elongated means.

4. The structure as recited by claim 3 taken in combination with an opening formed in said pliable rear wall, said handle extending through said opening, interlocking members mounted along each side of said opening, a zipper head secured to said handle on the upper and lower side of said handle, said zipper heads engaging said interlocking members permitting the sliding of said handle along said opening.

5. The structure as recited by claim 4 wherein said bottom end wall means comprises a rigid reinforcing member extending therealong and said ground engaging wheels being secured to said rigid reinforcing member and a pair of arm members pivotally mounted at one end to said rigid reinforcing member forming a bracket for carrying baggage thereon.

6. The structure as recited by claim 5 and a strap handle mounted at the mid-portion of said rear wall for carrying said garment bag when in a folded position.

7. In combination:

a flexible and foldable garment container;

means within said container for holding said container in an inflexible and unfolded condition;

said holding means including first means within said container for allowing bending of said holding means whereby said container may be folded; and said holding means further including second means coupled to said first means and extending through said container for permitting operation of said first means from outside of said container.

8. The combination recited in claim 7 further comprising means on said container for effecting a low friction contact with a supporting surface.

9. The combination recited in claim 8 wherein said low friction contacting means comprises at least one wheel outside of said container.

10. The combination recited in claim 9 further comprising a brace member extending across one end of said container.

11. The combination recited in claim 10 wherein said holding means comprises a rod extending within said container and substantially normal to said brace member.

12. The combination recited in claim 11 wherein said low friction contacting means is carried by said brace member.

13. The combination recited in claim 7 wherein said holding means comprises a rod extending within said container.

14. The combination recited in claim 13 wherein said first means comprises a hinge along said rod.

15. A portable luggage carrier comprising:

a brace member;

a rod extending substantially normal to said brace member;

first means for allowing folding of said rod;

a wheel carried by said brace member; and a flexible container surrounding said rod and foldable therewith.

16. The luggage carrier recited in claim 15, further comprising a leg pivotted to said brace member and rotatable to a position transverse to said brace member.

17. The luggage carrier recited in claim 15 further comprising second means extending through said container for permitting operation of said first means outside of said container.

* * * * *